US009464857B2

(12) United States Patent
Lessard

(10) Patent No.: US 9,464,857 B2
(45) Date of Patent: Oct. 11, 2016

(54) SOUND SUPPRESSOR FOR A FIREARM

(71) Applicant: Sig Sauer, Inc., Newington, NH (US)

(72) Inventor: Ethan Lessard, East Kingston, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 14/587,136

(22) Filed: Dec. 31, 2014

(65) Prior Publication Data

US 2015/0323275 A1 Nov. 12, 2015

Related U.S. Application Data

(60) Provisional application No. 61/925,447, filed on Jan. 9, 2014.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34; F41A 21/325
USPC ..... 89/14.4
See application file for complete search history.

(56) References Cited

U.S. PATENT DOCUMENTS 5,356,183 A * 10/1994 Cole ..... F16L 25/0045 285/148.27
6,412,389 B2 * 7/2002 Fluhr ..... F41A 21/30 181/223
7,661,349 B1 * 2/2010 Brittingham ..... F41A 21/30 181/223
7,676,976 B2 * 3/2010 Dueck ..... F41A 21/30 42/90
7,735,406 B1 * 6/2010 Olson ..... F41A 21/325 89/14.3
7,743,693 B1 6/2010 Brittingham
7,789,009 B1 9/2010 Brittingham
8,091,462 B2 * 1/2012 Dueck ..... F41A 21/325 42/76.01
8,201,487 B2 * 6/2012 Dueck ..... F41A 21/26 42/96

(Continued)

OTHER PUBLICATIONS

"Firearms History, Technology & Development: Supressors a.k.a. Silencers—Part I", http://firearmhistory.blogspot.com/2011/05/supressors-aka-silencers-part-i.html, May 29, 2011, 2 pages.

(Continued)

*Primary Examiner* — Michelle R Clement
(74) *Attorney, Agent, or Firm* — Finch & Maloney PLLC

(57) ABSTRACT

A sound suppressor for a firearm is disclosed. In accordance with some embodiments, the disclosed sound suppressor may include a thread and taper arrangement and a latching mechanism configured, for example, to secure the sound suppressor to a flash suppressor and/or the muzzle of a host firearm. Such features can help, in accordance with some embodiments, to prevent or otherwise reduce the opportunity for the sound suppressor to inadvertently back off of the host weapon during firing. Also, the disclosed sound suppressor may be configured, in accordance with some embodiments, such that application thereto of a wrench or other suitable torquing device automatically disengages the latching mechanism. In some instances, this may allow an operator to apply torque to rotate the sound suppressor while simultaneously disengaging the locking/retention feature. The mechanical advantage provided by the wrench can help to break fused areas resulting from copper and/or carbon fouling.

19 Claims, 8 Drawing Sheets

(56) References Cited

U.S. PATENT DOCUMENTS

| | | | | |
|---|---|---|---|---|
| 8,490,535 | B1 * | 7/2013 | Moore | F41A 21/30 181/223 |
| 8,499,676 | B1 * | 8/2013 | Moore | F41A 21/325 42/90 |
| 8,763,510 | B2 * | 7/2014 | Dueck | F41A 21/26 89/14.4 |
| 8,950,546 | B2 * | 2/2015 | Shults | F41A 21/30 181/223 |
| 2001/0049996 | A1 * | 12/2001 | Fluhr | F41A 21/30 89/14.4 |
| 2006/0060076 | A1 * | 3/2006 | Dueck | F41A 21/30 89/14.4 |
| 2010/0199834 | A1 * | 8/2010 | Dueck | F41A 21/30 89/14.4 |
| 2010/0313743 | A1 * | 12/2010 | Dueck | F41A 21/325 89/14.05 |
| 2012/0272818 | A1 * | 11/2012 | Dueck | F41A 21/30 89/14.4 |

OTHER PUBLICATIONS

Adelmann, Steve, "Suppressor Basics," Shooting Illustrated, http://www.shootingillustrated.com/index.php/24620/supressor-basics, Jun. 20, 2012, 4 pages.

Adelmann, Steve, "The Truth About Suppressors," Shooting Illustrated, http://www.shootingillustrated.com/index.php/1349/the-truth-aboutsuppressors, Oct. 26, 2010, 5 pages.

* cited by examiner

SOUND SUPPRESSOR FOR A FIREARM

CROSS-REFERENCE TO RELATED APPLICATIONS

This patent application claims the benefit of U.S. Provisional Patent Application No. 61/925,447, titled "Sound Suppressor for a Firearm," filed on Jan. 9, 2014, which is herein incorporated by reference in its entirety.

FIELD OF THE DISCLOSURE

The present disclosure relates to projectile weapons and more particularly to accessories for use with projectile weapons.

BACKGROUND

Weapons design involves a number of non-trivial challenges, and projectile weapons have faced particular complications with regard to sound suppression.

SUMMARY

One example embodiment provides a sound suppressor for a firearm, the sound suppressor including: a socket portion configured to receive at least one of a flash suppressor and/or a firearm muzzle, the socket portion including a wrench flat; and a latching mechanism pivotally mounted on the socket portion and configured to be brought into physical register with a flash suppressor and/or a firearm muzzle received by the socket portion, wherein application of a wrench to the wrench flat causes the latching mechanism to be taken out of physical register with the flash suppressor and/or the firearm muzzle. In some cases, the socket portion further includes an interior threaded portion configured to be brought into threaded engagement with a corresponding exterior threaded portion of a flash suppressor and/or a firearm muzzle received by the socket portion. In some instances, the socket portion further includes an interior tapered portion configured to physically interface with a corresponding exterior tapered portion of a flash suppressor and/or a firearm muzzle received by the socket portion. In some cases, the latching mechanism, when in physical register with a flash suppressor and/or a firearm muzzle received by the socket portion, prevents rotational movement of the sound suppressor. In some instances, at least a portion of the sound suppressor is comprised of a material that is compliant with United States Defense Standard MIL-W-13855 (Weapons: Small Arms and Aircraft Armament Subsystems, General Specification For). In some cases, a firearm including the sound suppressor is provided. In some such cases, the firearm includes at least one of a pistol, a submachine gun, a machine gun, and/or a rifle.

Another example embodiment provides a suppressor assembly including: a flash suppressor configured to be attached to a firearm muzzle, the flash suppressor having an exterior channel formed therein; and a sound suppressor configured to be brought into mated engagement with the flash suppressor, the sound suppressor including a latching mechanism comprising: a latch body having a latch arm formed at a first end thereof and a tab portion formed at a second end thereof, wherein the latch arm extends through a sidewall of the sound suppressor and is configured to be brought into physical register with the exterior channel of the flash suppressor; and a spring operatively interfaced with the tab portion of the latch body and configured to bias the latch arm into physical register with the exterior channel of the flash suppressor. In some instances, the sound suppressor further includes a wrench flat configured such that application of a wrench thereto causes the latch arm of the latching mechanism to be taken out of physical register with the exterior channel of the flash suppressor, freeing the sound suppressor to move rotationally. In some such instances, rotation of the wrench causes rotation of the sound suppressor with respect to the flash suppressor. In some cases, the latching mechanism further comprises a pin configured to provide a pivot point about which the latch body can rotate when the spring is compressed and/or expanded. In some instances, the flash suppressor and the sound suppressor are configured to be brought into threaded engagement with one another. In some cases, the flash suppressor and the sound suppressor include tapered, conical surfaces that physically interface with one another. In some instances, the latching mechanism, when in physical register with the flash suppressor, prevents rotational movement of the sound suppressor.

Another example embodiment provides a suppressor assembly including: a flash suppressor having a channel formed in an exterior thereof; and a sound suppressor configured to be threaded onto the flash suppressor, the sound suppressor comprising: a latching mechanism configured to physically register with the channel of the flash suppressor so as to prevent the sound suppressor from backing off of the flash suppressor while the latching mechanism is engaged; and a wrench flat configured such that application of a wrench thereto causes the latching mechanism to be taken out of physical register with the channel of the flash suppressor, thereby disengaging the latching mechanism and allowing the sound suppressor to be backed off of the flash suppressor. In some cases, the channel of the flash suppressor is annular in shape and circumscribes the flash suppressor. In some instances, the latching mechanism is integrated into a socket portion of the sound suppressor, the socket portion configured to receive the flash suppressor. In some cases, the latching mechanism includes: a latch including: a curved latch body; a latch arm formed at a first end of the curved latch body, the latch arm extending radially inward with respect to the curved latch body; and a tab portion formed at a second end of the curved latch body, the tab portion extending laterally with respect to the curved latch body; a pin inserted within an aperture formed in the curved latch body between the latch arm and the tab portion; and a spring operatively interfaced with the tab portion of the curved latch body. In some such cases, the spring biases the latch arm into physical register with the channel of the flash suppressor. In some cases, the sound suppressor further comprises a recess formed in the wrench flat, the recess configured to receive the tab portion of the latching mechanism when it is depressed against the spring operatively interfaced therewith.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
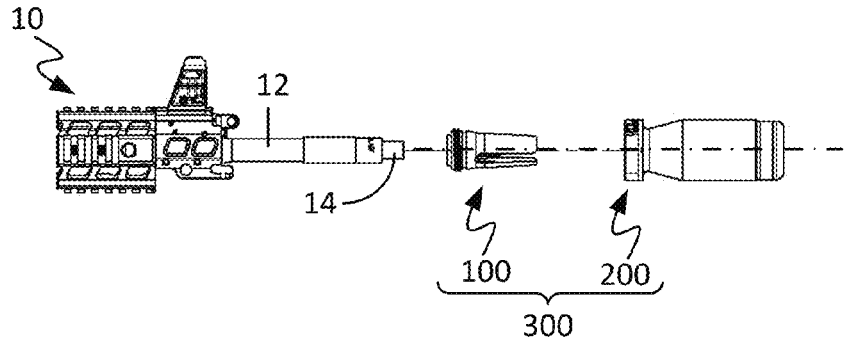
FIG. 1 is a side view of a host firearm and a suppressor assembly configured in accordance with an embodiment of the present disclosure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the present disclosure to the specific configurations shown. In short, the figures are provided merely to show example structures.

DETAILED DESCRIPTION

A sound suppressor for a firearm is disclosed. In accordance with some embodiments, the disclosed sound suppressor may include a thread and taper arrangement and a latching mechanism configured, for example, to secure the sound suppressor to a flash suppressor and/or the muzzle of a host firearm. Such features can help, in accordance with some embodiments, to prevent or otherwise reduce the opportunity for the sound suppressor to inadvertently back off of the host weapon during firing. Also, the disclosed sound suppressor may be configured, in accordance with some embodiments, such that application thereto of a wrench or other suitable torquing device automatically disengages the latching mechanism. In some instances, this may allow an operator to apply torque to rotate the sound suppressor while simultaneously disengaging the locking/retention feature. The mechanical advantage provided by the wrench/torquing device can help to break fused areas resulting from copper and/or carbon fouling. Numerous configurations and variations will be apparent in light of this disclosure.

General Overview

Existing sound suppressor designs tend to trap copper and carbon residue during usage, making them susceptible to a variety of mechanical difficulties. Through repeated firing, copper and carbon fouling can fuse a sound suppressor to the barrel and/or flash suppressor of a host firearm, making it difficult to detach the sound suppressor. This can reduce the effectiveness of the host firearm and detract from the overall tactical advantage offered by utilizing a sound suppressor, particularly in instances in which quick detachment thereof may be desired.

Thus, a sound suppressor for a firearm is disclosed. In accordance with some embodiments, the disclosed sound suppressor may include a thread and taper arrangement and a latching mechanism configured, for example, to secure the sound suppressor to a flash suppressor and/or to the muzzle of a host firearm. In accordance with some embodiments, these features can prevent or otherwise reduce the opportunity for the sound suppressor to inadvertently back off of the host weapon during firing. In some cases, this may realize a reduction in the likelihood of mechanical failure of the weapon system, thus improving the performance and reliability of the host weapon and safety to the operator.

The disclosed sound suppressor may be configured, in accordance with some embodiments, such that application thereto (e.g., sliding on; clamping down; tightening up) of a wrench or other suitable torquing device automatically disengages the latching mechanism. In some instances, this may allow an operator, in a single action, to apply torque to rotate the sound suppressor while simultaneously maintaining disengagement of the locking/retention feature. The mechanical advantage provided by the wrench device can help to break any fused areas resulting from copper and/or carbon fouling, in some cases making it easier to swiftly detach the sound suppressor from an associated flash suppressor and/or firearm muzzle.

As will be appreciated in light of this disclosure, the disclosed sound suppressor may be utilized with any of a wide range of firearms of any desired caliber, including, for example, pistols, submachine guns, machine guns, and/or rifles. Also, some embodiments may include small form factor components constructed from materials which may be lightweight, resilient, and/or inexpensive. In some such instances, minimal (or otherwise negligible) mass and/or bulk may be added to the host weapon, thereby helping to maintain a reliable, lightweight, compact weapon system. Also, in some instances, a reduction in cost (e.g., of production, repair, and/or replacement) may be realized.

It should be noted that, while generally referred to herein as a 'sound suppressor' for consistency and ease of understanding of the present disclosure, the disclosed sound suppressor is not so limited to that specific terminology. The disclosed sound suppressor alternatively can be referred to, for example, as a silencer, noise suppressor, or firearm muffler in other embodiments, as will be appreciated in light of this disclosure. Similarly, the disclosed 'flash suppressor' alternatively can be referred to as a flash guard, flash eliminator, flash hider, or flash cone in other embodiments. As will be further appreciated, the particular configuration, materials, dimensions, etc., of a suppressor assembly (e.g., sound suppressor and/or flash suppressor) configured as described herein may be varied, for example, depending on whether the target application or end-use is military, tactical, or civilian in nature. Numerous configurations will be apparent in light of this disclosure.

In some embodiments, the disclosed suppressor assembly (e.g., sound suppressor and/or flash suppressor) optionally can be configured to be operatively interfaced with one or more other weapon accessories. For example, in some embodiments, the disclosed suppressor assembly may be configured to be operatively interfaced with a blank firing device (e.g., as may be used for training exercises or other instances in which blank cartridges are utilized). In some embodiments, the disclosed suppressor assembly may be configured to be operatively interfaced with a brush guard (e.g., which may be used to help reduce the likelihood of becoming entangled with vegetation and similar environmental hazards). Some embodiments may be configured to permit attachment of a bayonet and/or light source on the host firearm. Other suitable accessories with which the disclosed suppressor assembly may be optionally interfaced will depend on a given application and will be apparent in light of this disclosure.

Structure and Operation

FIG. 1 is a side view of a host firearm 10 and a suppressor assembly 300 configured in accordance with an embodiment of the present disclosure. As can be seen, suppressor assembly 300 can include a muzzle flash suppressor 100 and a sound suppressor 200, in some embodiments. As discussed herein, flash suppressor 100 can be configured to be operatively attached to the muzzle 14 of the barrel 12 of a firearm 10 (or other suitable host weapon), and sound suppressor 200 can be configured to be operatively attached with flash suppressor 200, in accordance with some embodiments. In some such cases, suppressor assembly 300 may be configured such that sound suppressor 200 can be detached from flash suppressor 100, while allowing flash suppressor 100 itself to remain operatively attached to the host firearm 10. It should be noted, however, that the present disclosure is not so limited, as in some other embodiments, sound suppressor 200 can be operatively attached directly to a firearm muzzle 14 without inclusion of an intervening flash suppressor 100. Numerous suitable configurations will be apparent in light of this disclosure.

Suppressor assembly 300 can be utilized, in part or in whole, with any of a wide range of firearms 10 of any desired caliber. For example, in accordance with some embodiments, the sound suppressor 200 and/or flash suppressor 100 of assembly 300 may be utilized with: a pistol; a submachine gun; a machine gun; and/or a rifle. Other suitable host weapons platforms which may utilize suppressor assembly 300, in part or in whole, will be apparent in light of this disclosure.

Figure 2A:
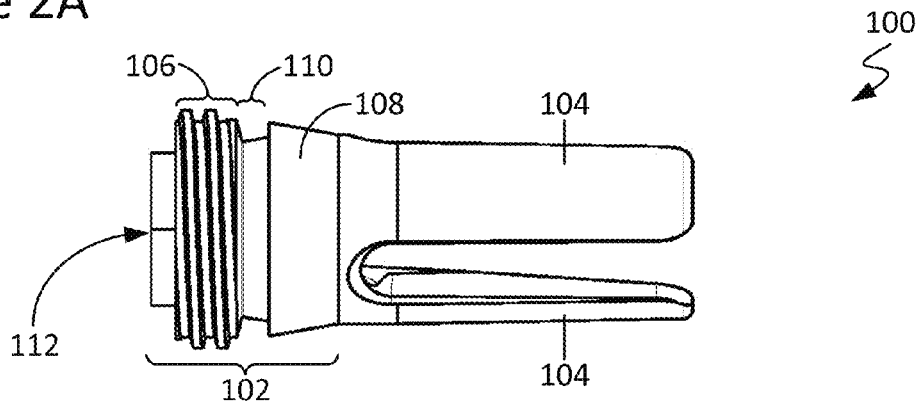
FIGS. 2A and 2B are side and perspective views, respectively, of a flash suppressor configured in accordance with an embodiment of the present disclosure.
Figure 2B:
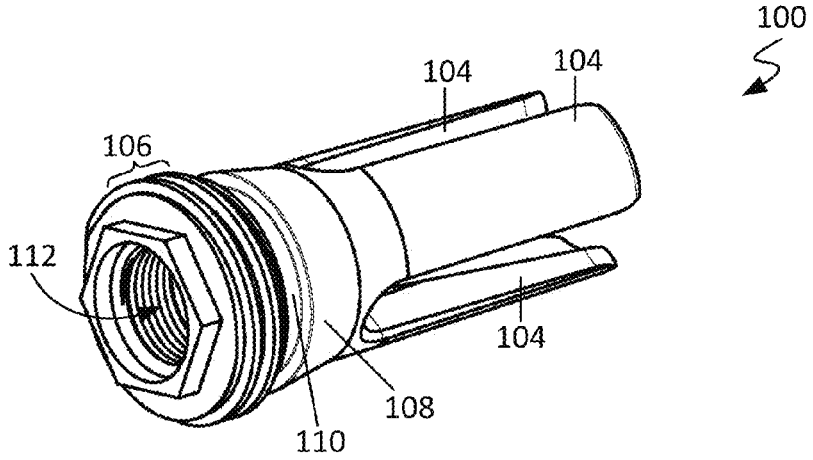

FIGS. 2A and 2B are side and perspective views, respectively, of a flash suppressor 100 configured in accordance with an embodiment of the present disclosure. The socket portion 102 of flash suppressor 100 may be configured, for example, to operatively attach flash suppressor 100 to the muzzle 14 of a host firearm 10. To that end, in some embodiments, the bore 112 of socket portion 102 may be threaded such that socket portion 102 may be screwed onto a correspondingly threaded muzzle 14 to affix flash suppressor 100 thereto. In some other embodiments, the bore 112 of socket portion 102 may be configured to receive a muzzle 14, and one or more set screws in the sidewall of socket portion 102 may be tightened against the outside of muzzle 14 to affix flash suppressor 100 thereto. In either case, flash suppressor 100 may be configured to be operatively attached with a firearm barrel 12 in a temporary or permanent manner, as desired for a given target application or end-use.

As can be seen, socket portion 102 may include an exterior threaded portion 106, in some embodiments. In some embodiments, exterior threaded portion 106 may be configured, for example, to permit flash suppressor 100 to be screwed into a corresponding interior threaded portion 206 (FIG. 3B) of sound suppressor 200, as discussed below. Thus, by virtue of this configuration, the exterior threaded portion 106 of flash suppressor 100 may contribute to mated engagement between flash suppressor 100 and sound suppressor 200, in accordance with some embodiments. Exterior threaded portion 106 may be configured as a male and/or female thread, as desired, in accordance with some embodiments. Numerous suitable configurations will be apparent in light of this disclosure.

Also, as can be seen, socket portion 102 may include an exterior tapered portion 108, in some embodiments. Exterior tapered portion 108 may be configured, for example, to be physically interfaced with a corresponding interior tapered portion 208 (FIG. 3B) of sound suppressor 200, as discussed below. In some instances, such physical interfacing may help to provide for a greater normal force and surface area contact between the interfaced surfaces of sound suppressor 200 and flash suppressor 100 (e.g., between exterior tapered portion 108 and interior tapered portion 208), thereby increasing the force of friction between those surfaces when assembled. In some instances, such physical interfacing may help to prevent or otherwise reduce the ability of sound suppressor 200 to inadvertently back off of flash suppressor 100. Thus, by virtue of this configuration, the exterior tapered portion 108 of flash suppressor 100 may contribute to maintenance of mated engagement between flash suppressor 100 and sound suppressor 200, in accordance with some embodiments. The taper angle of exterior tapered portion 108 may be customized as desired, and in some cases may be made to complement the taper angle of interior tapered portion 208, in accordance with some embodiments. In some instances, exterior tapered portion 108 may be at least partially conical in geometry.

As can be seen further, socket portion 102 may include an exterior channel 110, in some embodiments. Exterior channel 110 may be formed, for example, between the exterior threaded portion 106 and the exterior tapered portion 108 of flash suppressor 100 and may circumscribe socket portion 102, at least in part. Also, exterior channel 110 may be configured, in accordance with some embodiments, to interface with the latch arm 252*a* of latch mechanism 250 (FIG. 3C) of sound suppressor 200, as discussed below.

The geometry and/or dimensions of exterior channel 110 can be customized as desired for a given target application or end-use. In some cases, exterior channel 110 may be generally annular (e.g., ring-like) in shape. In some instances, exterior channel 110 may fully circumscribe socket portion 102, while in some other instances it may only partially circumscribe socket portion 102 (e.g., less than or equal to about three-quarters of the circumference of socket portion 102; less than or equal to about one-half of the circumference of socket portion 102; less than or equal to about one-third of the circumference of socket portion 102). As will be appreciated in light of this disclosure, it may be desirable in some cases to ensure that the dimensions (e.g., width, length, depth) of exterior channel 110 are sufficient, for example, to permit latch arm 252*a* to operate therein. Other suitable geometries and dimensions for exterior channel 110 will depend on a given application and will be apparent in light of this disclosure.

As can be seen further, for example, from FIGS. 2A-2B, flash suppressor 100 may include a plurality of prongs 104 extending from socket portion 102. The depicted example flash suppressor 100 includes three prongs 104 formed about the perimeter of socket portion 102, and those prongs 104 are generally spaced equidistantly (e.g., a given pair of neighboring prongs 104 may be approximately 120° offset from one another about the perimeter of socket portion 102). However, the present disclosure is not so limited, as the quantity, arrangement, and/or dimensions of the prongs 104 of flash suppressor 100 can be customized as desired for a given target application or end-use. Numerous suitable configurations will be apparent in light of this disclosure.

Flash suppressor 100 can be constructed from any suitable material (or combination of materials). For example, in some embodiments, flash suppressor 100 may be constructed from a stainless steel, such as AISI 4130 steel or any other suitable grade. In some instances, it may be desirable to ensure that flash suppressor 100 is constructed from material(s) that may be corrosion-resistant, reliable over a large temperature range (e.g., in the range of about −50° F. to 170° F.), and/or resistant to deformation and/or fracture. In a more general sense, flash suppressor 100 can be constructed from any suitable material which is compliant, for example, with United States Defense Standard MIL-W-13855 (Weapons: Small Arms and Aircraft Armament Subsystems, General Specification For). Other suitable materials for flash suppressor 100 will depend on a given application and will be apparent in light of this disclosure.

The geometry and/or dimensions (e.g., diameter/width, length, mass) of flash suppressor 100 can be customized as desired for a given target application or end-use. In some embodiments, flash suppressor 100 may have a generally cylindrical tubular geometry of a generally annular (e.g., ring-like) cross-sectional profile. In some cases, it may be desirable to ensure that the bore 112 of flash suppressor 100 substantially aligns (e.g., is precisely aligned or otherwise within an acceptable tolerance) with the centerline of the bore of the muzzle 14 of a host firearm 10, as this may help to prevent or otherwise reduce the likelihood of contact between a discharged projectile and an interior sidewall of flash suppressor 100. Other suitable geometries and dimensions for flash suppressor 100 will depend on a given application and will be apparent in light of this disclosure.

Figure 3A:
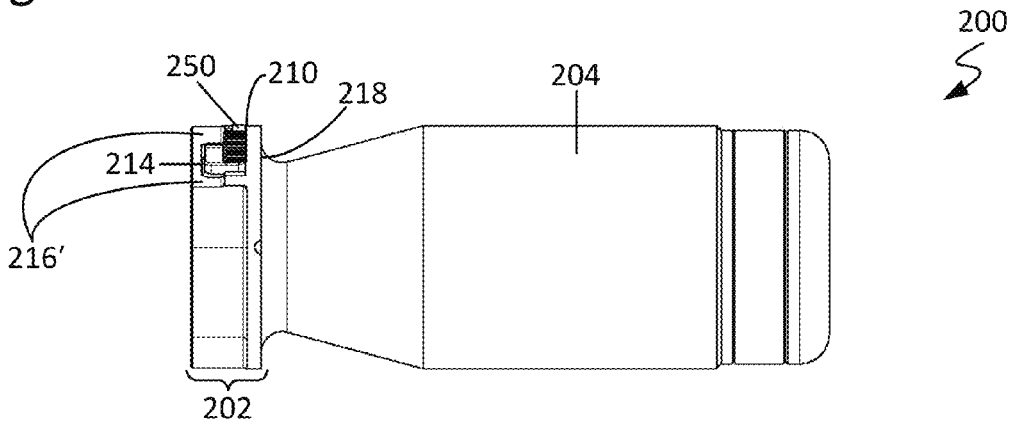
FIGS. 3A and 3B are side and perspective views, respectively, of a sound suppressor configured in accordance with an embodiment of the present disclosure.
Figure 3B:
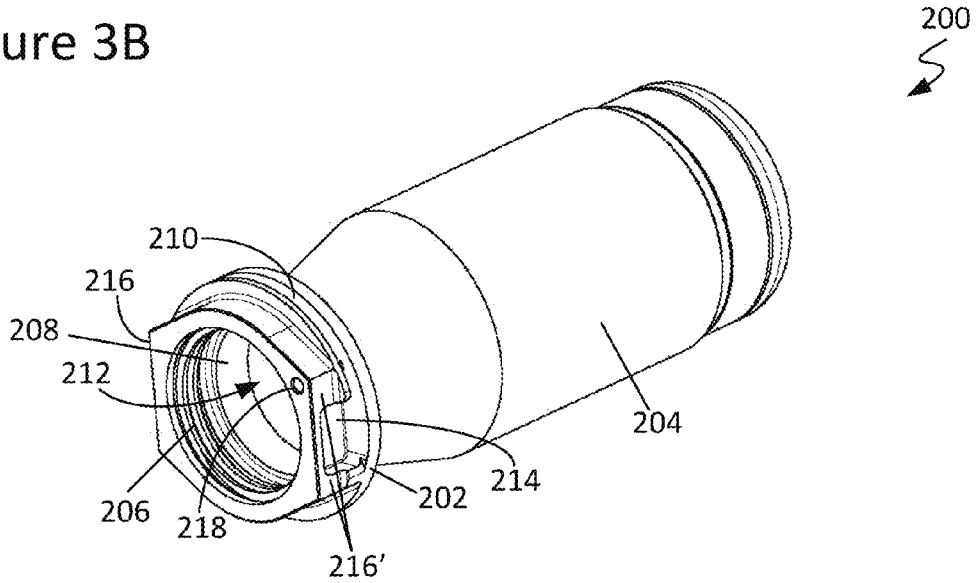

FIGS. 3A and 3B are side and perspective views, respectively, of a sound suppressor 200 configured in accordance with an embodiment of the present disclosure. As discussed herein, sound suppressor 200 may include a socket portion 202, a body portion 204 extending from socket portion 202, and a latching mechanism 250 hosted by (e.g., integrated with) socket portion 202. The socket portion 202 of sound suppressor 200 may be configured, for example, to operatively attach sound suppressor 200 to at least one of a flash suppressor 100 and/or a firearm muzzle 14. More particularly, in accordance with some embodiments, socket portion 202 may be configured to operatively attach sound suppressor 200 to a flash suppressor 100, which in turn may be operatively attached to the muzzle 14 of a host firearm 10. In accordance with some other embodiments, socket portion 202 may be configured to operatively attach sound suppressor 200 directly to the muzzle 14 of a host firearm 10 without inclusion of an intervening flash suppressor 100. In either case, sound suppressor 200 may be configured to be operatively attached to a flash suppressor 100 and/or a firearm muzzle 14 in a temporary or permanent manner, as desired for a given target application or end-use.

To these ends, socket portion 202 may include an interior threaded portion 206, in some embodiments. Interior threaded portion 206 may be configured, for example, to permit sound suppressor 200 to be screwed onto a correspondingly threaded exterior threaded portion 106 of flash suppressor 100. Thus, by virtue of this configuration, the interior threaded portion 206 of sound suppressor 200 may contribute to mated engagement between sound suppressor 200 and flash suppressor 100, in accordance with some embodiments. In accordance with some other embodiments, interior threaded portion 206 may be configured to be screwed onto a correspondingly threaded firearm muzzle 14. Thus, by virtue of this configuration, the interior threaded portion 206 of sound suppressor 200 may contribute to mated engagement between sound suppressor 200 and the muzzle 14 of a firearm barrel 12, in accordance with some embodiments. Interior threaded portion 206 may be configured as a male and/or female thread, as desired, in accordance with some embodiments. Numerous suitable configurations will be apparent in light of this disclosure.

In accordance with some embodiments, the socket portion 202 of sound suppressor 200 further may include an interior tapered portion 208. In some cases, the interior tapered portion 208 may be configured to be physically interfaced with a corresponding exterior tapered portion 108 of flash suppressor 100, as previously noted. Also, as previously noted, such physical interfacing may help to prevent or otherwise reduce the ability of sound suppressor 200 to inadvertently back off of flash suppressor 100, in some instances. By virtue of this configuration, the interior tapered portion 208 of sound suppressor 200 may contribute to maintenance of mated engagement between sound suppressor 200 and flash suppressor 100, in accordance with some embodiments. The taper angle of interior tapered portion 208 may be customized as desired, and in some cases may be made to complement the taper angle of exterior tapered portion 108, in accordance with some embodiments. In some instances, interior tapered portion 208 may be at least partially conical in geometry.

Socket portion 202 further may include an exterior channel 210, in some embodiments. Exterior channel 210 may be formed, for example, in an exterior region of socket portion 202 which generally lies between the locations of interior threaded portion 206 and interior tapered portion 208 of sound suppressor 200, in accordance with some embodiments. As can be seen from FIG. 4B, for example, the location of the exterior channel 210 of sound suppressor 200 may be made to coincide (e.g., precisely align or otherwise align within an acceptable tolerance) with the exterior channel 110 of flash suppressor 100, in accordance with some embodiments. Also, as discussed herein, at least a portion of exterior channel 210 may traverse the entire thickness of the sidewall of socket portion 202 of sound suppressor 200. Thus, by virtue of this configuration, the latch arm 252*a* (FIG. 3C) of latching mechanism 250 may be allowed to pass therethrough and into physical register with the exterior channel 110 of flash suppressor 100 (or the exterior of muzzle 14, if sound suppressor 200 is mounted directly thereon), in accordance with some embodiments. Furthermore, as can be seen from the figures, the exterior channel 210 of sound suppressor 200 may transition laterally to a recess 214 (discussed below) at an end thereof.

The geometry and/or dimensions of exterior channel 210 can be customized as desired for a given application or end-use. In some embodiments, exterior channel 210 may be generally curved in shape (e.g., an arc that at least partially circumscribes sound suppressor 200). It may be desirable in some cases to ensure that the dimensions (e.g., width, length, depth) of exterior channel 210 are sufficient, for example, to permit the latch 252 (FIG. 3C) of latching mechanism 250 to operate therein. Other suitable geometries and dimensions for the exterior channel 210 of sound suppressor 200 will depend on a given application and will be apparent in light of this disclosure.

Also, as can be seen from FIGS. 3A-3B, sound suppressor 200 includes a body portion 204 extending from socket portion 202. Body portion 204 may be configured, for example, to divert and/or trap propellant gas from a round that is discharged by a host firearm 10, as typically done. Thus, in some instances, sound suppressor 200 may help to preserve an operator's hearing and/or reduce the audible signature of the operator. Also, in some cases, a reduction in firing recoil may be achieved with a sound suppressor 200 configured as described herein. Furthermore, in some embodiments, sound suppressor 200 may help to reduce the operator's visible signature, for example, by facilitating a reduction in muzzle flash. To these ends, the configuration of the body portion 204 of sound suppressor 200 can be customized as desired for a given target application or end-use.

Figure 7A:
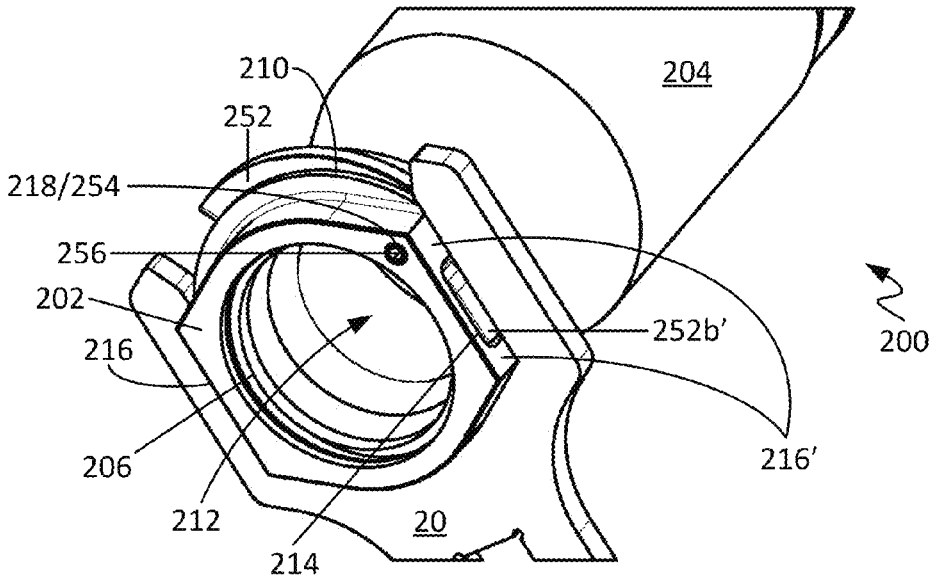
FIGS. 7A and 7B are partial perspective and end views, respectively, of a sound suppressor illustrating disengagement of its latch mechanism by application of a wrench thereto, in accordance with an embodiment of the present disclosure.
Figure 7B:
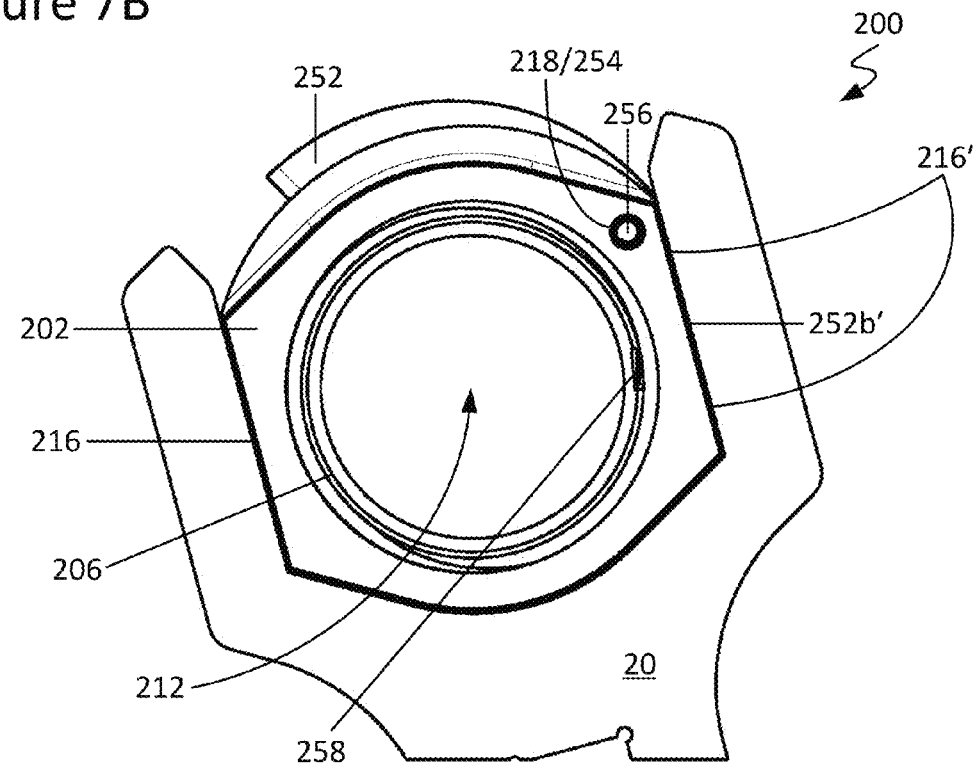

As can be seen in FIG. 3B, the socket portion 202 of sound suppressor 200 also may include one or more wrench flats 216/216', in accordance with some embodiments. The quantity (e.g., one, two, three, four, five, or more) and/or arrangement (e.g., square, pentagonal, hexagonal, etc.) of wrench flats 216/216' can be customized as desired for a given target application or end-use. For instance, in the figures, the depicted example flash suppressor 200 includes first wrench flat 216 and second wrench flat 216' that are formed about socket portion 202 and positioned substantially opposite one another (e.g., approximately 180° offset from one another across the diameter/width of socket portion 202). As can be seen further, at least one wrench flat (e.g., wrench flat 216') may be provided with a recess 214 formed therein, in accordance with some embodiments. Recess 214 may be configured to receive the tab portion 252*b* (FIG. 3C) of latch 252, for instance, when it is depressed by a wrench 20 (FIGS. 7A-7B) or other suitable torquing device, in accordance with some embodiments. It should be noted that, while generally referred to herein as 'wrench flats' for consistency and ease of understanding of the present disclosure, the wrench flats 216/216' of sound suppressor 200 is not so limited to that specific terminology, as in a more general sense, wrench flats 216/216' can be any type of suitable surface which may provide grip or other mechanical advantage for application of torque to rotate sound suppressor 200 with respect to the flash suppressor 100 and/or the muzzle 14 to which it is attached. Numerous suitable configurations will be apparent in light of this disclosure.

The dimensions (e.g., length, width, depth) of the wrench flats 216/216' of sound suppressor 200 can be customized as desired for a given target application or end-use. As will be appreciated in light of this disclosure, it may be desirable to ensure that the wrench flats 216/216' are of sufficient dimensions to permit application of a wrench 20 (FIGS. 7A-7B) or other suitable torquing device thereto. As will be further appreciated, it may be desirable to ensure that wrench flat 216', for example, is of sufficient dimensions to permit tab portion 252*b* to be displaced into recess 214, in accordance with some embodiments.

Also, as can be seen from FIGS. 3A-3B, socket portion 202 of sound suppressor 200 may have an aperture 218 formed therein. In some embodiments, aperture 218 may pass through the full width of wrench flat 216', traversing the width of exterior channel 210. Also, aperture 218 may be configured to receive pin 256 (FIG. 3C) of latching mechanism 250 to allow latch 252 to rotate about pin 256, in accordance with some embodiments.

Sound suppressor 200 can be constructed from any suitable material (or combination of materials). For example, in some cases, sound suppressor 200 may be constructed from a stainless steel, such as AISI 4130 steel or any other suitable grade. In some instances, it may be desirable to ensure that sound suppressor 200 is constructed from material(s) that may be corrosion-resistant, reliable over a large temperature range (e.g., in the range of about −50° F. to 170° F.), and/or resistant to deformation and/or fracture. In a more general sense, sound suppressor 200 can be constructed from any suitable material which is compliant, for example, with United States Defense Standard MIL-W-13855 (Weapons: Small Arms and Aircraft Armament Subsystems, General Specification For). Other suitable materials for sound suppressor 200 will depend on a given application and will be apparent in light of this disclosure.

Also, the geometry and/or dimensions (e.g., diameter/width, length, mass) of sound suppressor 200 can be customized as desired for a given target application or end-use. In some embodiments, sound suppressor 200 may have a generally tubular geometry of a generally annular (e.g., ring-like) cross-sectional profile. In some cases, it may be desirable to ensure that the bore 212 of sound suppressor 200 substantially aligns (e.g., is precisely aligned or otherwise within an acceptable tolerance) with the centerline of the bore of the muzzle 14 of a host firearm 10, as this may help to prevent or otherwise reduce the likelihood of contact between a discharged projectile and an interior sidewall of sound suppressor 200. Other suitable geometries and dimensions for sound suppressor 200 will depend on a given application and will be apparent in light of this disclosure.

Figure 3C:
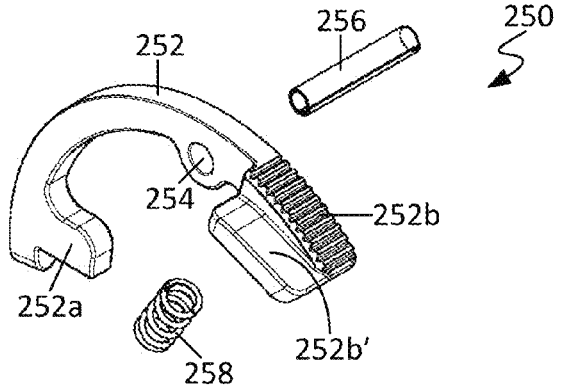
FIG. 3C is an exploded view of a latching mechanism configured in accordance with an embodiment of the present disclosure.

FIG. 3C is an exploded view of latching mechanism 250, configured in accordance with an embodiment of the present disclosure. As can be seen, latching mechanism 250 may include, for example, a latch 252, a pin 256, and a spring 258, in some embodiments. Also, as discussed herein, latching mechanism 250 may be configured to secure sound suppressor 200 to a flash suppressor 100 and/or a firearm muzzle 14, in accordance with some embodiments. To that end, latching mechanism 250 may be pivotally mounted on/within socket portion 202, in some embodiments.

In accordance with some embodiments, latch 252 can be configured to be disposed, at least in part, within exterior channel 210 of sound suppressor 200 (e.g., see FIG. 3A). The body of latch 252 may be generally curved, and in some example cases may substantially match the curved contour provided by the exterior channel 210. One end of latch 252 may transition, for example, to a latch arm 252*a*. In accordance with some embodiments, latch arm 252*a* may extend radially inward (e.g., with respect to the curvature of the body of latch 252, as previously noted). Thus, when latch 252 is disposed within exterior channel 210, latch arm 252*a* may extend radially inward through the sidewall of socket portion 202 and into the bore 212 of sound suppressor 200, in accordance with some embodiments. In some cases, latch arm 252*a* may be configured to come into physical register with the exterior channel 110 of flash suppressor 100 when sound suppressor 200 is operatively engaged therewith. In some other cases, latch arm 252*a* may be configured to come into physical register with the exterior of a firearm muzzle 14, if sound suppressor 200 is directly mounted thereto, for example, without an intervening flash suppressor 100. In some embodiments, the end of latch arm 252*a* may be contoured or otherwise configured to facilitate the physical register of latch arm 252*a* with a given surface of incidence (e.g., the sidewalls that define exterior channel 110 of flash suppressor 100; a suitably configured firearm muzzle 14).

As can be seen further, the other end of latch 252 may transition, for example, to a tab portion 252*b*. In accordance with some embodiments, tab portion 252*b* may extend laterally from the body of latch 252. Thus, when latch 252 is disposed within exterior channel 210, tab portion 252*b* may extend, at least in part, over recess 214 in the socket portion 202 of sound suppressor 200. Tab portion 252*b* may be of sufficient dimensions to allow it to be incident with an applied wrench 20 (FIGS. 7A-7B) or other suitable torquing device, as discussed herein. In some embodiments, tab portion 252*b* may include a ramped or otherwise angled portion 252*b*' that is configured to extend, at least in part, above the surface contour of wrench flat 216' when latch 252 is disposed within exterior channel 210. Angled portion 252*b*' can be sloped in any desired direction, and in accordance with some embodiments, may be substantially flat or curved/non-planar. In some instances, the presence of angled portion 252*b*' may help to ensure that a wrench 20/torquing device applied to wrench flat 216' is sufficiently incident with tab portion 252*b* to cause latch 252 to rotate about pin 256, as described herein.

Also, as can be seen, the body of latch 252 may include an aperture 254 formed therein, for example, along its length between latch arm 252*a* and tab portion 252*b*. The placement of aperture 254 along the body of latch 252 may be selected, for example, so as to align with a corresponding aperture 218 formed in socket portion 202 of sound suppressor 200. Aperture 254 may traverse the entire thickness of the body of latch 252 (e.g., may pass through from one side to the other side of latch 252) and can be dimensioned to receive pin 256 therein. In accordance with some embodiments, pin 256 may be configured to pivotally couple latch 252 with sound suppressor 200 such that latch 252 may be permitted to rotate within a desired range of motion in either direction about pin 256 within the exterior channel 210 of sound suppressor 200. To that end, pin 256 may be received, at least in part, by: (1) the aperture 254 formed in latch 252; and/or (2) the aperture 218 formed in the socket portion 202 of sound suppressor 200. Thus, in a general sense, pin 256, aperture 254, and aperture 218 collectively may serve as the pivot point of latch assembly 250, in accordance with some embodiments.

In accordance with some embodiments, spring 258 can be configured to provide a restoring force that serves to bias latch arm 252*a* into physical register with an underlying incident surface (e.g., the exterior channel 110 of flash suppressor 100, if sound suppressor 200 is mounted thereto; the exterior of a firearm muzzle 14, if sound suppressor 200 is directly mounted thereto). To that end, spring 258 may be a helical coil compression spring, in some embodiments. It should be noted, however, that the present disclosure is not so limited, as in a more general sense, spring 258 can be any type of spring or resilient material that provides a sufficient restoring force to suitably bias latch 252 for a given target application or end-use.

In accordance with some embodiments, spring 258 may be configured to reside, at least in part, within recess 214 under tab portion 252*b* of latch 252. Thus, by virtue of this configuration, when tab portion 252*b* of latch 252 is pressed inward into recess 214 (e.g., such as by a wrench 20 or other suitable torquing device), spring 258 may undergo compression. When tab portion 252*b* of latch 252 is released from being pressed inward into recess 214, spring 258 may expand from its compressed state. Other suitable configurations for latching mechanism 250 (e.g., latch 252, pin 256, and/or spring 258) will depend on a given application and will be apparent in light of this disclosure.

Latching mechanism 250 can be constructed from any suitable material (or combination of materials). For example, in some embodiments, at least a portion (e.g., latch 252, pin 256, and/or spring 258) of latching mechanism 250 may be constructed from a stainless steel of any suitable grade. In some instances, it may be desirable to ensure that latching mechanism 250 is constructed from material(s) that may be corrosion-resistant, reliable over a large temperature range (e.g., in the range of about −50° F. to 170° F.), and/or resistant to deformation and/or fracture. In a more general sense, latching mechanism 250 can be constructed from any suitable material which is compliant, for example, with United States Defense Standard MIL-W-13855 (Weapons: Small Arms and Aircraft Armament Subsystems, General Specification For). Furthermore, the dimensions (e.g., length, width/thickness, mass, etc.) of latch 252, pin 256, and/or spring 258 can be customized as desired for a given target application or end-use. Other suitable materials and dimensions for latching mechanism 250 will depend on a given application and will be apparent in light of this disclosure.

Figure 4A:
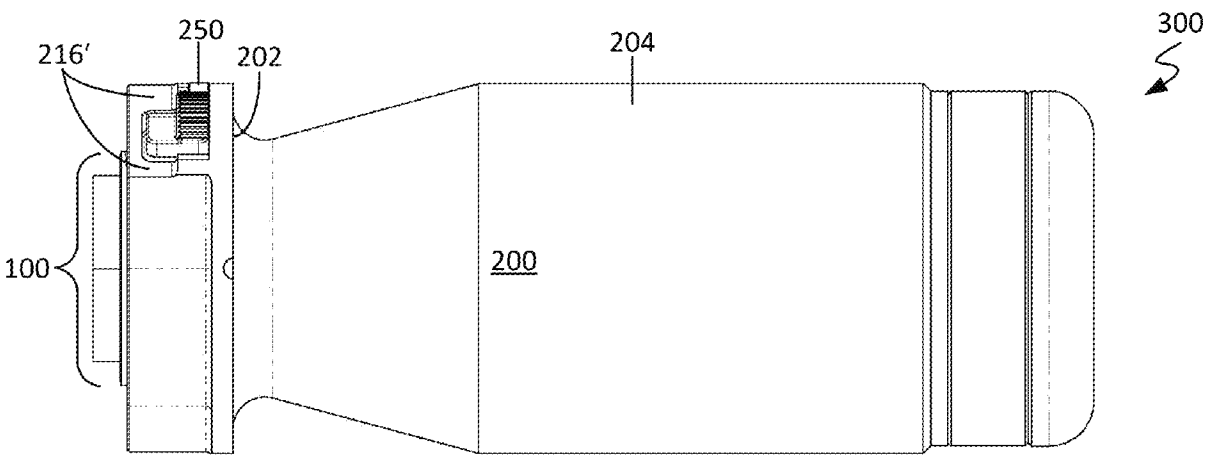
FIGS. 4A and 4B are side and side cross-sectional views, respectively, of a suppressor assembly configured in accordance with an embodiment of the present disclosure.
Figure 4B:
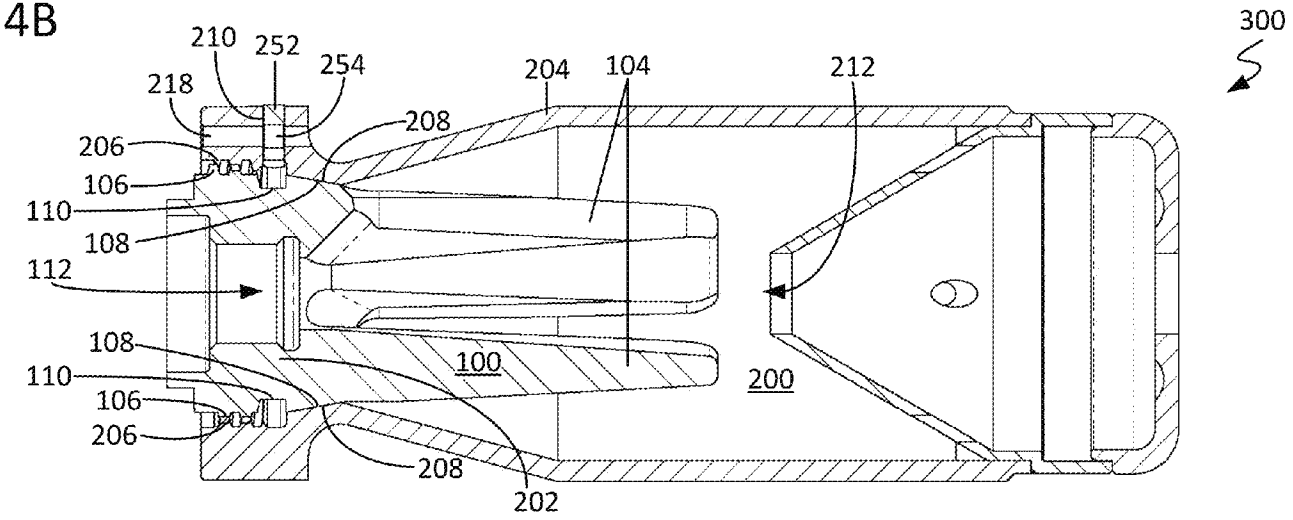
Figure 5A:
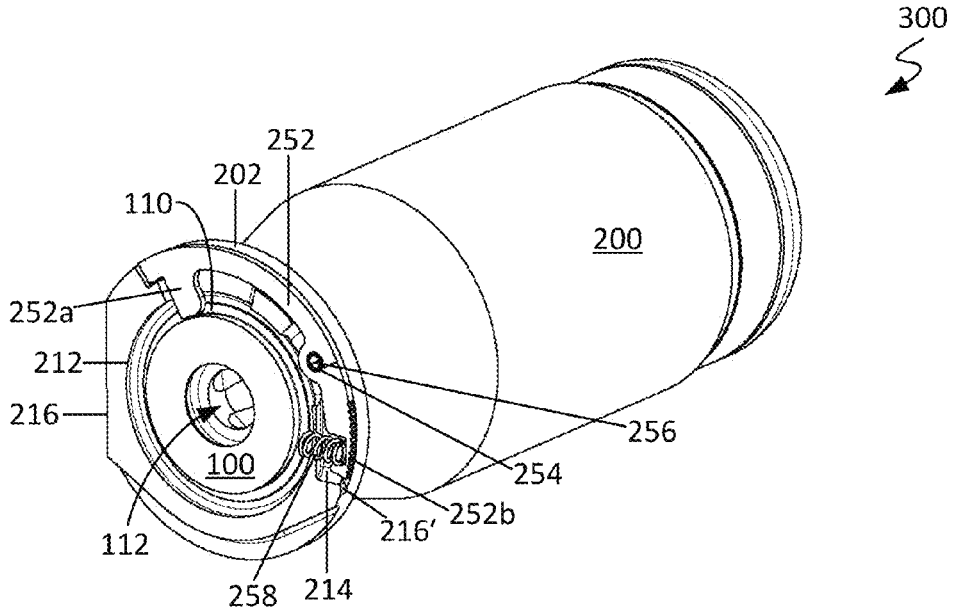
FIGS. 5A and 5B are perspective and end cutaway views, respectively, of a suppressor assembly with its latch mechanism in an engaged position, in accordance with an embodiment of the present disclosure.
Figure 5B:
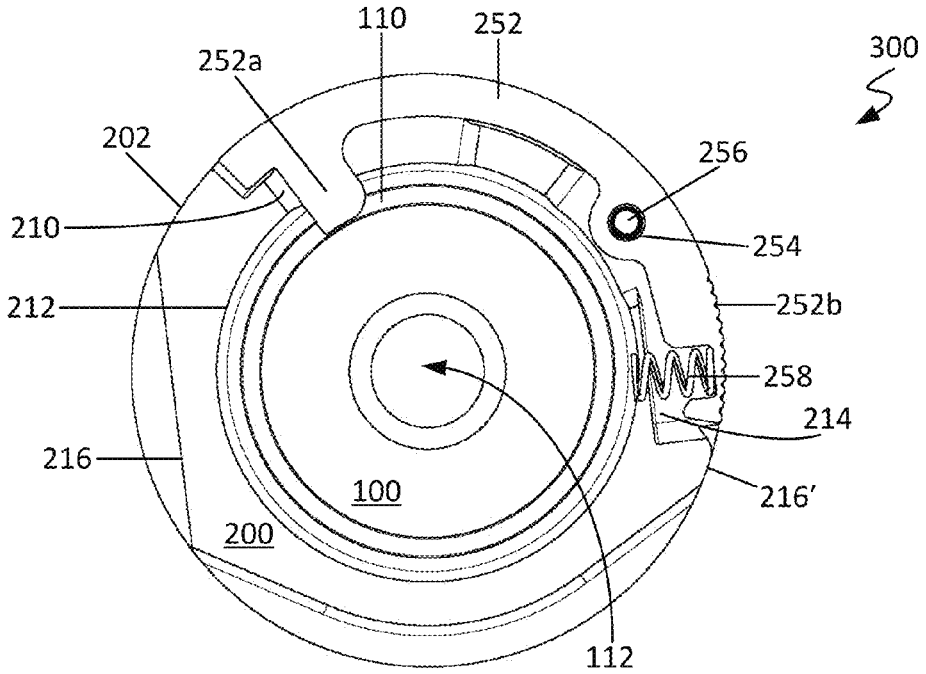
Figure 5C:
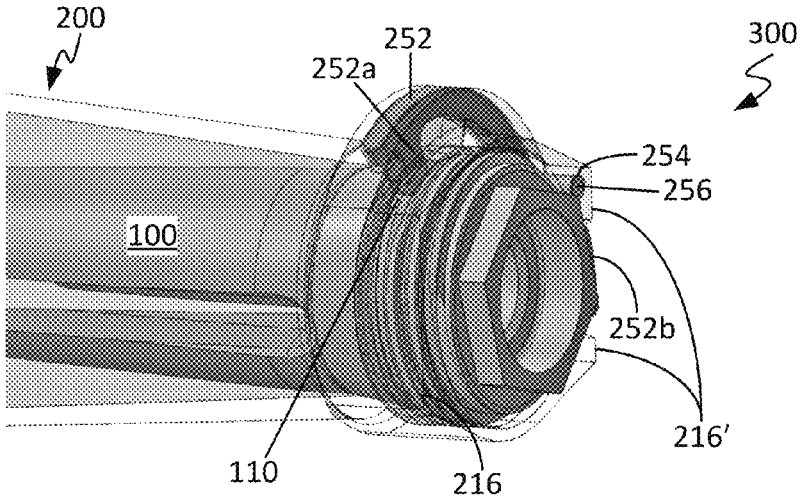
FIG. 5C is a partially transparent perspective view of a suppressor assembly with its latch mechanism in an engaged position, in accordance with an embodiment of the present disclosure.
Figure 5D:
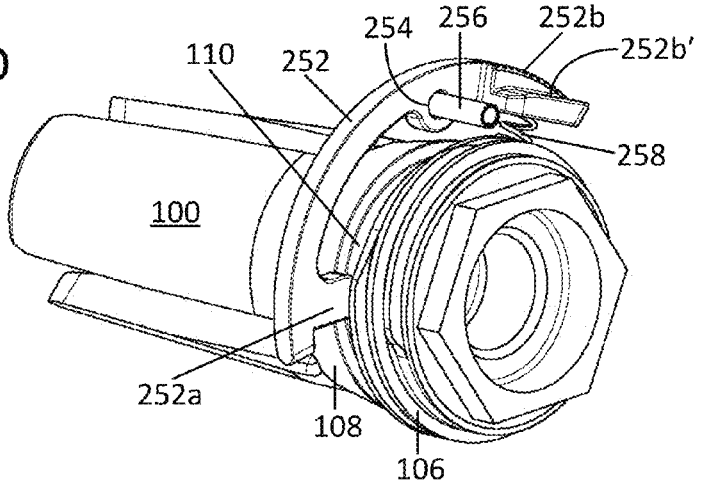
FIGS. 5D and 5E are perspective views illustrating engagement between a latching mechanism and a flash suppressor, in accordance with an embodiment of the present disclosure.
Figure 5E:
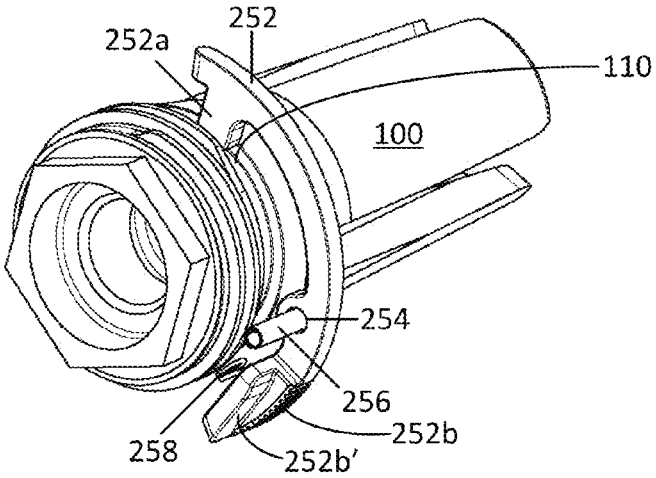
Figure 6A:
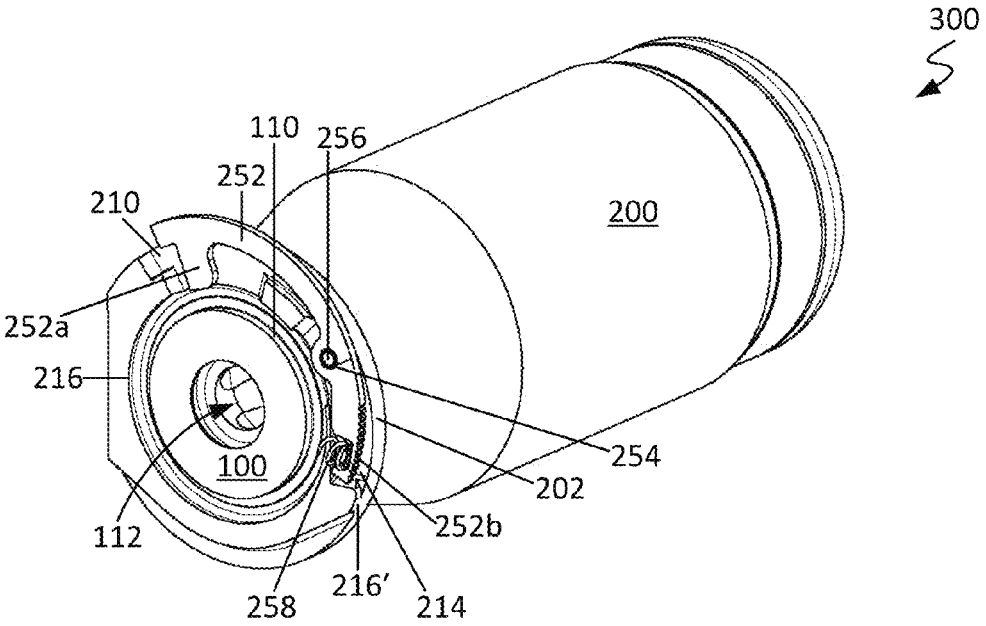
FIGS. 6A and 6B are perspective and end cutaway views, respectively, of a suppressor assembly with its latch mechanism in a disengaged position, in accordance with an embodiment of the present disclosure.
Figure 6B:
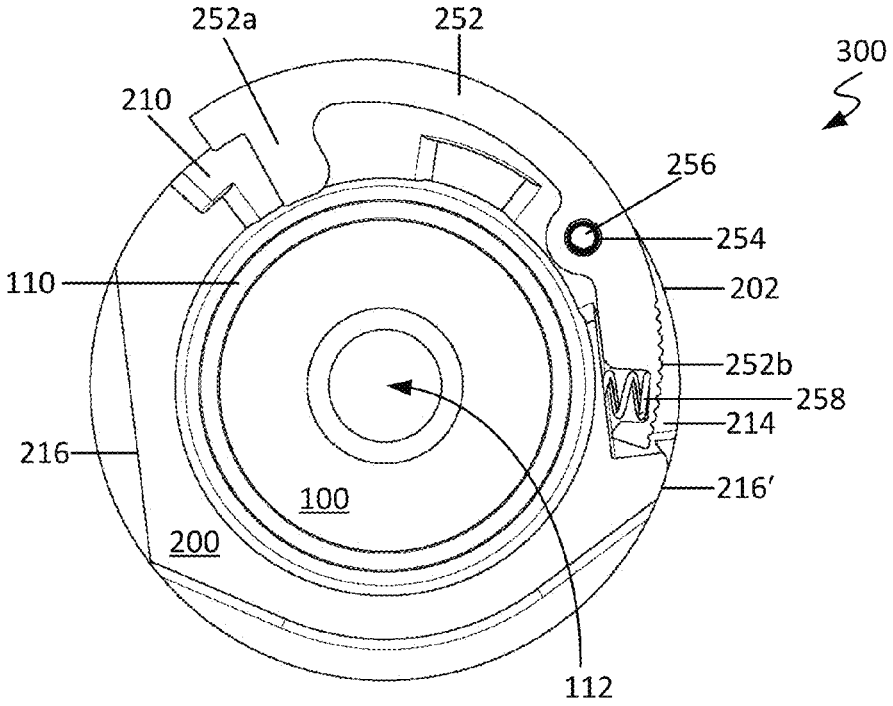
Figure 6C:
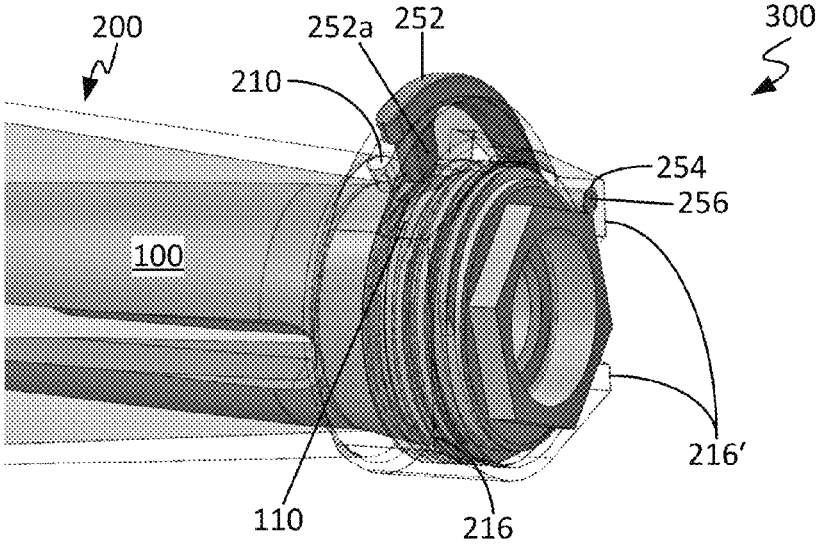
FIG. 6C is a partially transparent perspective view of a suppressor assembly with its latch mechanism in a disengaged position, in accordance with an embodiment of the present disclosure.
Figure 6D:
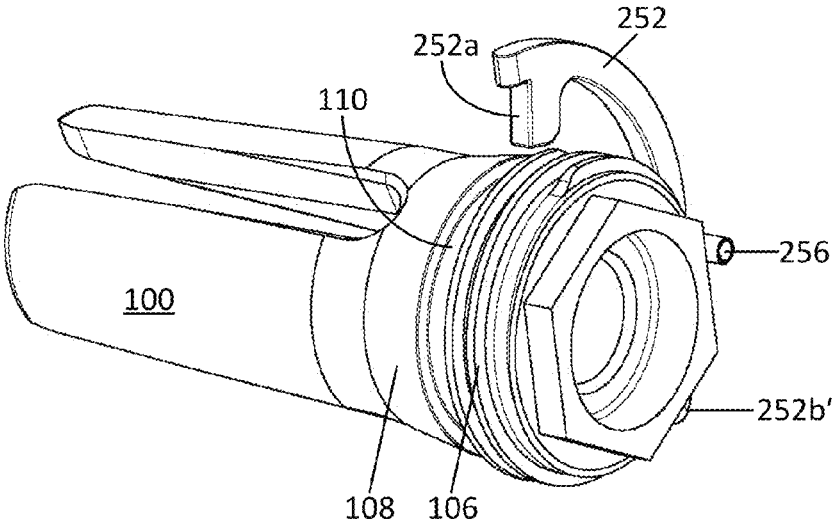
FIG. 6D is a perspective view illustrating disengagement of a latching mechanism from a flash suppressor, in accordance with an embodiment of the present disclosure.

FIGS. 4A and 4B are side and side cross-sectional views, respectively, of a suppressor assembly 300 configured in accordance with an embodiment of the present disclosure. As previously discussed, sound suppressor 200 can be configured, in accordance with some embodiments, to be brought into mated engagement with a flash suppressor 100. To that end, exterior threaded portion 106 of flash suppressor 100 may operatively engage interior threaded portion 206 of sound suppressor 200 as can be seen, for example, from FIG. 4B. Also, as can be seen from FIG. 4B, exterior tapered portion 108 of flash suppressor 100 may operatively interface with the interior tapered portion 208 of sound suppressor 200, in accordance with some embodiments. As can be seen further from FIG. 4B, latch arm 252*a* may extend through the sidewall of socket portion 202 of sound suppressor 200 and come into physical register with exterior channel 110 of flash suppressor 100, in accordance with some embodiments. As previously noted, and in accordance with some embodiments, latching mechanism 250 may serve, at least in part, to prevent or otherwise reduce the likelihood that sound suppressor 200 may detach inadvertently from: (1) a flash suppressor 100 with which it is mated; and/or (2) a muzzle 14, if sound suppressor 200 is directly mounted thereto without an intervening flash suppressor 100.

FIGS. 5A-5E illustrate several views of suppressor assembly 300 with latch mechanism 250 in an engaged position, in accordance with some embodiments of the present disclosure. As can be seen, when latch assembly 250 is engaged, latch arm 252*a* may extend through exterior channel 210 and the sidewall of sound suppressor 200 and come to reside, at least in part, between the sidewalls of the exterior channel 110 of flash suppressor 100, in accordance with some embodiments. By virtue of this configuration, sound suppressor 200 may be prevented or otherwise hindered in its ability to advance linearly in relation to flash suppressor 100 (i.e., rotate about and thus back off of flash suppressor 100) while latch assembly 250 is engaged, in accordance with some embodiments. Latch arm 252*a* may be held in such position, for example, by spring 258, which provides a restoring force that biases latch 252 into an engaged position.

However, the present disclosure is not so limited. As previously noted, in some embodiments, sound suppressor 200 may be directly mounted to a host firearm 10 without an intervening flash suppressor 100. In some such cases, sound suppressor 200 may be prevented or otherwise hindered in its ability to advance linearly in relation to muzzle 14 (i.e., rotate about and thus back off of muzzle 14) while latch assembly 250 is engaged.

FIGS. 6A-6D illustrate several views of suppressor assembly 300 with latch mechanism 250 in a disengaged position, in accordance with some embodiments of the present disclosure. As can be seen, when latch assembly 250 is disengaged, latch arm 252*a* may be withdrawn, at least in part, from the exterior channel 210 and the sidewall of sound suppressor 200, and thus may be withdrawn from exterior channel 110 of flash suppressor 100, in accordance with some embodiments. To that end, tab portion 252*b* may be depressed (e.g., by a wrench 20 or other suitable torquing device) against the restoring force of underlying spring 258, into underlying recess 214. Consequently, latch 252 may rotate about pin 256, and latch arm 252*a* may be withdrawn from exterior channel 110. By virtue of this configuration, when latch assembly 250 is disengaged, sound suppressor 200 may be permitted to advance linearly in relation to flash suppressor 100 (i.e., back off of flash suppressor 100), in accordance with some embodiments.

As previously noted, sound suppressor 200 may be configured, in accordance with some embodiments, for application of a wrench 20 or other suitable torquing device thereto. For example, consider FIGS. 7A and 7B, which are partial perspective and end views, respectively, of sound suppressor 200 illustrating disengagement of latch mechanism 250 by application of a wrench 20 thereto, in accordance with an embodiment of the present disclosure. As can be seen, application of a wrench 20 to wrench flat 216' (e.g., such as by sliding wrench 20 there over) may bring wrench 20 into physical contact with tab portion 252*b* (e.g., with angled portion 252*b'* thereof), forcing it downward into underlying recess 214. To that end, angled portion 252*b'* may be tapered in any desired direction with respect to wrench flat 216' to allow for wrench 20 to slide over and thus depress tab portion 252*b* within recess 214 while wrench 20 is applied, in accordance with some embodiments. In some embodiments, wrench 20 can be, for example, an open-end wrench, an adjustable wrench, a strap-type wrench, or any other torquing device suitable for use with suppressor assembly 300 (e.g., flash suppressor 100 and/or sound suppressor 200). Wrench 20 can be applied to wrench flat 216' from any direction and, in some cases the direction of application may depend, at least in part, on the direction of the slope of angled portion 252*b'* (e.g., to facilitate the ability of wrench 20 to slide over wrench flat 216').

As a result of applying wrench 20, latch 252 may rotate about pin 256, and latch arm 252*a* may be withdrawn from external channel 110 of flash suppressor 100. Therefore, in a general sense, latching mechanism 250 may be configured, in some embodiments, to be automatically disengaged upon application (e.g., sliding on; clamping down; tightening up) of a wrench 20 or other suitable torquing device. Thus, and in accordance with some embodiments, an operator may be able to engage wrench flats 216/216' with a wrench 20 (or other suitable torquing device), for example: (1) to disengage the locking/retention feature provided by latching mechanism 250 to allow attachment/detachment of sound suppressor 200; and/or (2) to apply sufficient torque to break any fused areas resulting from copper and/or carbon fouling that may occur during usage with a host firearm 10. When latching mechanism 250 is disengaged, sound suppressor 200 may be free to move rotationally (e.g., such as by turning of wrench 20), in accordance with some embodiments. When tab portion 252*b* is released from its depressed position, the restoring force of spring 258 may drive tab portion 252*b* out of recess 214, causing latch 252 to rotate about pin 256, in turn driving latch arm 252*a* into physical register with exterior channel 110 (or the exterior of muzzle 14), in accordance with some embodiments.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A sound suppressor for a firearm, the sound suppressor comprising:

a socket portion configured to receive at least one of a flash suppressor and a firearm muzzle, the socket portion including a wrench flat; and a latching mechanism pivotally mounted on the socket portion and configured to be brought into physical register with at least one of a flash suppressor and a firearm muzzle received by the socket portion, wherein application of a wrench to the wrench flat causes the latching mechanism to be taken out of physical register with at least one of the flash suppressor and the firearm muzzle.

2. The sound suppressor of claim 1, wherein the socket portion further includes an interior threaded portion configured to be brought into threaded engagement with at least one of a corresponding exterior threaded portion of a flash suppressor and a firearm muzzle received by the socket portion.

3. The sound suppressor of claim 1, wherein the socket portion further includes an interior tapered portion configured to physically interface with at least one of a corresponding exterior tapered portion of a flash suppressor and a firearm muzzle received by the socket portion.

4. The sound suppressor of claim 1, wherein the latching mechanism, when in physical register with at least one of a flash suppressor and a firearm muzzle received by the socket portion, prevents rotational movement of the sound suppressor.

5. A firearm comprising the sound suppressor of claim 1.

6. The firearm of claim 5, wherein the firearm comprises at least one of a pistol, a submachine gun, a machine gun, and a rifle.

7. A suppressor assembly comprising:

a flash suppressor configured to be attached to a firearm muzzle, the flash suppressor having an exterior channel formed therein; and a sound suppressor configured to be brought into mated engagement with the flash suppressor, the sound suppressor including a latching mechanism comprising:

a latch body having a latch arm formed at a first end thereof and a tab portion formed at a second end thereof, wherein the latch arm extends through a sidewall of the sound suppressor and is configured to be brought into physical register with the exterior channel of the flash suppressor; and a spring operatively interfaced with the tab portion of the latch body and configured to bias the latch arm into physical register with the exterior channel of the flash suppressor.

8. The suppressor assembly of claim 7, wherein the sound suppressor further includes a wrench flat configured such that application of a wrench thereto causes the latch arm of the latching mechanism to be taken out of physical register with the exterior channel of the flash suppressor, freeing the sound suppressor to move rotationally.

9. The suppressor assembly of claim 8, wherein rotation of the wrench causes rotation of the sound suppressor with respect to the flash suppressor.

10. The suppressor assembly of claim 7, wherein the latching mechanism further comprises a pin configured to provide a pivot point about which the latch body can rotate when the spring is at least one of compressed and expanded.

11. The suppressor assembly of claim 7, wherein the flash suppressor and the sound suppressor are configured to be brought into threaded engagement with one another.

12. The suppressor assembly of claim 7, wherein the flash suppressor and the sound suppressor include tapered, conical surfaces that physically interface with one another.

13. The suppressor assembly of claim 7, wherein the latching mechanism, when in physical register with the flash suppressor, prevents rotational movement of the sound suppressor.

14. A suppressor assembly comprising:

a flash suppressor having a channel formed in an exterior thereof; and a sound suppressor configured to be threaded onto the flash suppressor, the sound suppressor comprising:

a latching mechanism configured to physically register with the channel of the flash suppressor so as to prevent the sound suppressor from backing off of the flash suppressor while the latching mechanism is engaged; and a wrench flat configured such that application of a wrench thereto causes the latching mechanism to be taken out of physical register with the channel of the flash suppressor, thereby disengaging the latching mechanism and allowing the sound suppressor to be backed off of the flash suppressor.

15. The suppressor assembly of claim 14, wherein the channel of the flash suppressor is annular in shape and circumscribes the flash suppressor.

16. The suppressor assembly of claim 14, wherein the latching mechanism is integrated into a socket portion of the sound suppressor, the socket portion configured to receive the flash suppressor.

17. The suppressor assembly of claim 14, wherein the latching mechanism comprises:

a latch comprising:

a curved latch body;

a latch arm formed at a first end of the curved latch body, the latch arm extending radially inward with respect to the curved latch body; and a tab portion formed at a second end of the curved latch body, the tab portion extending laterally with respect to the curved latch body;

a pin inserted within an aperture formed in the curved latch body between the latch arm and the tab portion; and a spring operatively interfaced with the tab portion of the curved latch body.

18. The suppressor assembly of claim 17, wherein the spring biases the latch arm into physical register with the channel of the flash suppressor.

19. The suppressor assembly of claim 17, wherein the sound suppressor further comprises a recess formed in the wrench flat, the recess configured to receive the tab portion of the latching mechanism when it is depressed against the spring operatively interfaced therewith.

* * * * *